US012359438B2

(12) United States Patent
Shan et al.

(10) Patent No.: US 12,359,438 B2
(45) Date of Patent: Jul. 15, 2025

(54) SUNSHADE CANOPY

(71) Applicant: Zhejiang Weiyijia Industry and Trade Co., Ltd., Taizhou (CN)

(72) Inventors: Weibing Shan, Taizhou (CN); Zaizong Yu, Taizhou (CN)

(73) Assignee: Zhejiang Weiyijia Industry and Trade Co., Ltd., Taizhou (CN)

( * ) Notice: Subject to any disclaimer, the term of this patent is extended or adjusted under 35 U.S.C. 154(b) by 286 days.

(21) Appl. No.: 18/181,775

(22) Filed: Mar. 10, 2023

(65) Prior Publication Data

US 2023/0295932 A1 Sep. 21, 2023

(30) Foreign Application Priority Data

Mar. 16, 2022 (CN) ..... 202220564088.X
Aug. 9, 2022 (CN) ..... 202222094804.5
Sep. 6, 2022 (CN) ..... 202222383227.1

(51) Int. Cl.
*E04F 10/10* (2006.01)
*E04H 15/00* (2006.01)
*E04H 15/34* (2006.01)
*E04H 15/58* (2006.01)

(52) U.S. Cl.
CPC ..... *E04F 10/10* (2013.01); *E04H 15/008* (2013.01); *E04H 15/34* (2013.01); *E04H 15/58* (2013.01)

(58) Field of Classification Search
CPC ..... E04F 10/10; E04F 10/08; E04F 10/02; E04H 15/34; E04H 15/008; E04H 15/18
USPC ..... 52/79.5
See application file for complete search history.

(56) References Cited

U.S. PATENT DOCUMENTS 4,315,386 A * 2/1982 Clarke ..... E04C 3/40 403/295
5,203,135 A * 4/1993 Bastian ..... F16B 7/0413 403/292
10,738,457 B1 * 8/2020 Hendry ..... E04B 1/1903
10,815,689 B2 10/2020 Ji et al.
10,858,840 B2 12/2020 Ji et al.
2006/0115324 A1 * 6/2006 Zenda ..... F16B 7/18 403/292
2015/0092400 A1 * 4/2015 Vincenzi ..... H02S 20/30 362/183

(Continued)

*Primary Examiner* — Paola Agudelo
(74) *Attorney, Agent, or Firm* — Westbridge IP LLC

(57) ABSTRACT

A sunshade canopy includes a frame comprising longitudinal beams and longitudinal beams; a canopy top arranged on the frame; and supporting legs supporting the frame. One of the longitudinal beams includes a first longitudinal beam section and a second longitudinal beam section which are connected via a first fixing member. The first fixing member has an upper connecting surface and a first side connecting surface which are perpendicular to each other and have screw holes. Upper walls and side walls of abutting ends of the first longitudinal beam section and the second longitudinal beam section are provided with screw holes corresponding to the screw holes of the first fixing member respectively. The first fixing member fastens the first longitudinal beam section and the second longitudinal beam section via bolts. The canopy top is covered with uniformly arranged sunshade panels which are connected to the longitudinal beams via connecting members.

18 Claims, 16 Drawing Sheets

(56) References Cited

U.S. PATENT DOCUMENTS

| | | | | |
|---|---|---|---|---|
| 2016/0010355 | A1* | 1/2016 | Bellve | E04H 9/024 52/79.5 |
| 2018/0094418 | A1* | 4/2018 | Winter | E04B 1/5831 |
| 2019/0186167 | A1* | 6/2019 | Ji | E04H 15/008 |
| 2020/0370299 | A1* | 11/2020 | Shan | E04F 10/10 |
| 2021/0262237 | A1* | 8/2021 | Vanthournout | E04F 10/08 |
| 2021/0332587 | A1* | 10/2021 | Geriavenko | E04F 10/10 |
| 2022/0235555 | A1* | 7/2022 | Liang | H02S 20/10 |
| 2022/0341181 | A1* | 10/2022 | Abeel | E04B 7/163 |
| 2023/0017313 | A1* | 1/2023 | Meether | E04B 1/388 |

* cited by examiner

SUNSHADE CANOPY

CROSS-REFERENCE TO RELATED APPLICATIONS

The present application claims priority to Chinese Patent Application No. 202220564088.X, filed on Mar. 16, 2022, Chinese Patent Application No. 202222094804.5, filed on Aug. 9, 2022, and Chinese Patent Application No. 202222383227.1, filed on Sep. 6, 2022. All of the aforementioned applications are hereby incorporated by reference in their entireties.

TECHNICAL FIELD

This application relates to the field of outdoor products, in particular to a sunshade canopy.

BACKGROUND

At present, sunshade canopies have become common outdoor products that are essential tools for people's leisure and outdoor activities. To better meet the needs of users, there are now more types of sunshade canopies available in different sizes. However, producing, packing, and shipping large sunshade canopies can be more expensive due to the longer frame lengths required.

SUMMARY

In view of the deficiencies in the prior art, the objective of the present application is to provide a sunshade canopy that can be disassembled to reduce costs of production, packaging, and transportation.

The above technical objective of the present application is achieved through the following technical solutions.

A sunshade canopy comprises: a frame comprising hollow longitudinal beams and hollow longitudinal beams; a canopy top arranged on the frame; and supporting legs supporting the frame; one of the longitudinal beams comprises a first longitudinal beam section and a second longitudinal beam section which are connected via a first fixing member; the first fixing member has an upper connecting surface and a first side connecting surface which are perpendicular to each other and have screw holes; upper walls and side walls of abutting ends of the first longitudinal beam section and the second longitudinal beam section are provided with screw holes corresponding to the screw holes on the upper connecting surface and the first side connecting surface of the first fixing member respectively; the first fixing member fastens the first longitudinal beam section and the second longitudinal beam section via bolts; and the canopy top is covered with uniformly arranged sunshade panels which are connected to the longitudinal beams via connecting members.

In an embodiment, the sunshade canopy further comprises a middle beam arranged in parallel between two adjacent longitudinal beams, the middle beam comprises a first middle beam section and a second middle beam section, upper walls and side walls of abutting ends of the first middle beam section and the second middle beam section are provided with screw holes corresponding to the screw holes on the upper connecting surface and the first side connecting surface of the third fixing member respectively, the third fixing member fastens the first middle beam section and the second middle beam section via bolts; the sunshade panels are connected to the middle beam via the connecting members.

In an embodiment, the first longitudinal beam section and the second longitudinal beam section are vertically provided with a first longitudinal beam groove and a second longitudinal beam groove respectively on a same straight line, the upper connecting surface of the first fixing member is provided with a first groove, and the first groove fits the first longitudinal beam groove and the second longitudinal beam groove to limit relative movement.

In an embodiment, the first middle beam section and the second middle beam section are vertically provided with a first middle beam groove and a second middle beam groove respectively on a same straight line, and the third groove fits the first middle beam groove and the second middle beam groove to limit relative movement.

In an embodiment, the first fixing member further comprises a second side connecting surface, side walls opposite to side walls connecting the longitudinal beams and/or the middle beam to the first side connecting surfaces fit the second side connecting surfaces.

In an embodiment, each of the sunshade panels comprises a shielding part and a connecting part, a rear end of the connecting part is provided with a first drainage groove with an upper opening horizontally, and a front side wall of the first drainage groove is provided with a fixing seat, an upper tail of the connecting member is provided with a protruding connecting column which is detachably connected with the fixing seat, a middle part of the connecting member is provided with a first connecting hole, the screw holes on inner sides of the longitudinal beams and/or the middle beam and the first connecting holes are connected via bolts so that the connecting members and the longitudinal beams and/or the middle beam are connected flexibly.

In an embodiment, the fixing seat is set as a through hole opened on a front side wall of the first drainage groove, and the connecting column passes through the through hole to form a fixed connection.

In an embodiment, the fixing seat is set as a limiting slot formed by bending a front side wall of the first drainage groove, and the connecting column is inserted into the limiting slot to form a fixed connection.

In an embodiment, the connecting member is an integrally formed member made of a plastic material, a front end of the connecting part is provided with a hook-shaped strip which extends downward to form a barb at a top end of the connecting part, a front end of the connecting member is provided with a hook-shaped groove opened upwards, the book-shaped groove has a same shape as the hook-shaped strip and form fixed fitting with the hook-shaped strip, a front side wall of the hook-shaped groove extends downwards and forms a pressing sheet, pressing the pressing sheet from a front side of the pressing sheet enlarges an opening of the hook-shaped groove.

In an embodiment, a front end of the shielding part is set as a downwardly inclined shielding edge, the shielding edge of a rear sunshade panel shields a rear wall of the first drainage groove of a front adjacent sunshade panel.

In an embodiment, the sunshade canopy further comprises a transmission device which comprises a fixed seat, a fixed shaft, a rotating shaft, a rotating strip, an active strip and a transmission strip, the fixed seat is fixedly connected on an inner side wall of the longitudinal beams and/or the middle beam. the fixed shaft is integrally arranged with the fixed seat, the fixed shaft is a cylindrical shape extending laterally to a middle part of the frame, the rotating shaft is horizontally arranged at an end close to the horizontal beams, and the rotating shaft is hollowly sleeved on the fixed shafts of both sides and is capable of axially rotating; an outer surface of an end of the rotating shaft is vertically connected to an end of the rotating strip, another end of the rotating strip and an end of the transmission strip are provided with screw holes, and both sides of the active strip are provided with screw holes, so that the another end of the rotating strip and the end of the transmission strip are movably connected with the both sides of the active strip via bolts; and the transmission strip is longitudinally provided with equidistant screw holes, tails of the connecting members are provided with second connecting holes, the connecting members are movably connected to the transmission strip via the second connecting holes and the screw holes on the transmission strip, the connecting members are movably connected with the longitudinal beams and/or the middle beam via bolts passing through the first connecting holes and the screw holes on the longitudinal beams and/or the middle beam, the rotating shaft rotates to realize opening and closing of the sunshade panels.

In an embodiment, the sunshade canopy further comprises a second fixing member, the transmission strip comprises a first transmission strip section and a second transmission strip section, abutting ends of the first transmission strip section and the second transmission strip section are respectively provided with screw holes, the second fixing member is provided with screw holes at both ends, and is fixedly connected to the first transmission strip section and the second transmission strip section by bolts.

In an embodiment, an upper side and a lower side of the second fixing member are respectively extended to form baffles, opposite sides of the baffles fit the upper side and the lower side of the transmission strip respectively to prevent relative movement.

In an embodiment, the sunshade canopy further comprises a steering gear which is fixedly arranged on an inner side of one of the second horizontal beam sections, the steering gear is connected with the rotating shaft, and drives the rotating shaft to rotate after realizing force transformation.

In an embodiment, the steering gear comprises a worm gear and a worm which are driven by rotation of a hand rocker.

In an embodiment, a middle part of the worm gear is set as a polygonal hole, and a connection part of the rotating shaft which is connected to the worm gear is set as a polygonal structure of the same shape.

In an embodiment, the steering gear is arranged between the middle beam and one of the longitudinal beams, and realizes transmission by connecting two rotation shafts of equal length located at a left side and a right side respectively.

In an embodiment, a second drainage groove is provided under inner side surfaces of the frame and has a same orientation as an orientation of the frame.

In an embodiment, the supporting legs are hollow, and drainage holes are opened at upper ends of the supporting legs, the drainage holes communicate with the second drainage groove, through holes are provided on side walls of lower ends of the supporting legs.

In an embodiment, one of the horizontal beams comprises a first horizontal beam section and a second horizontal beam section which are connected via the fourth fixing member; upper walls and side walls of abutting ends of the first horizontal beam section and the second horizontal beam section are provided with screw holes corresponding to the screw holes on the upper connecting surface and the first side connecting surface of the fourth fixing member respectively; the first horizontal beam section and the second horizontal beam section are vertically provided with a first horizontal beam groove and a second horizontal beam groove respectively on a same straight line, the first groove fits the first longitudinal beam groove and the second longitudinal beam groove to limit relative movement, the fourth fixing member fastens the first horizontal beam section and the second horizontal beam section via bolts.

In view of the above, the advantageous effects of the present application compared to the prior art are as follows: one of the long longitudinal beams in the sunshade canopy is divided into two sections: a first longitudinal beam section and a second longitudinal beam section which are connected and disassembled by fasteners, which reduces production difficulty and transportation costs.

DETAILED DESCRIPTIONS OF THE EMBODIMENTS

Figure 1:
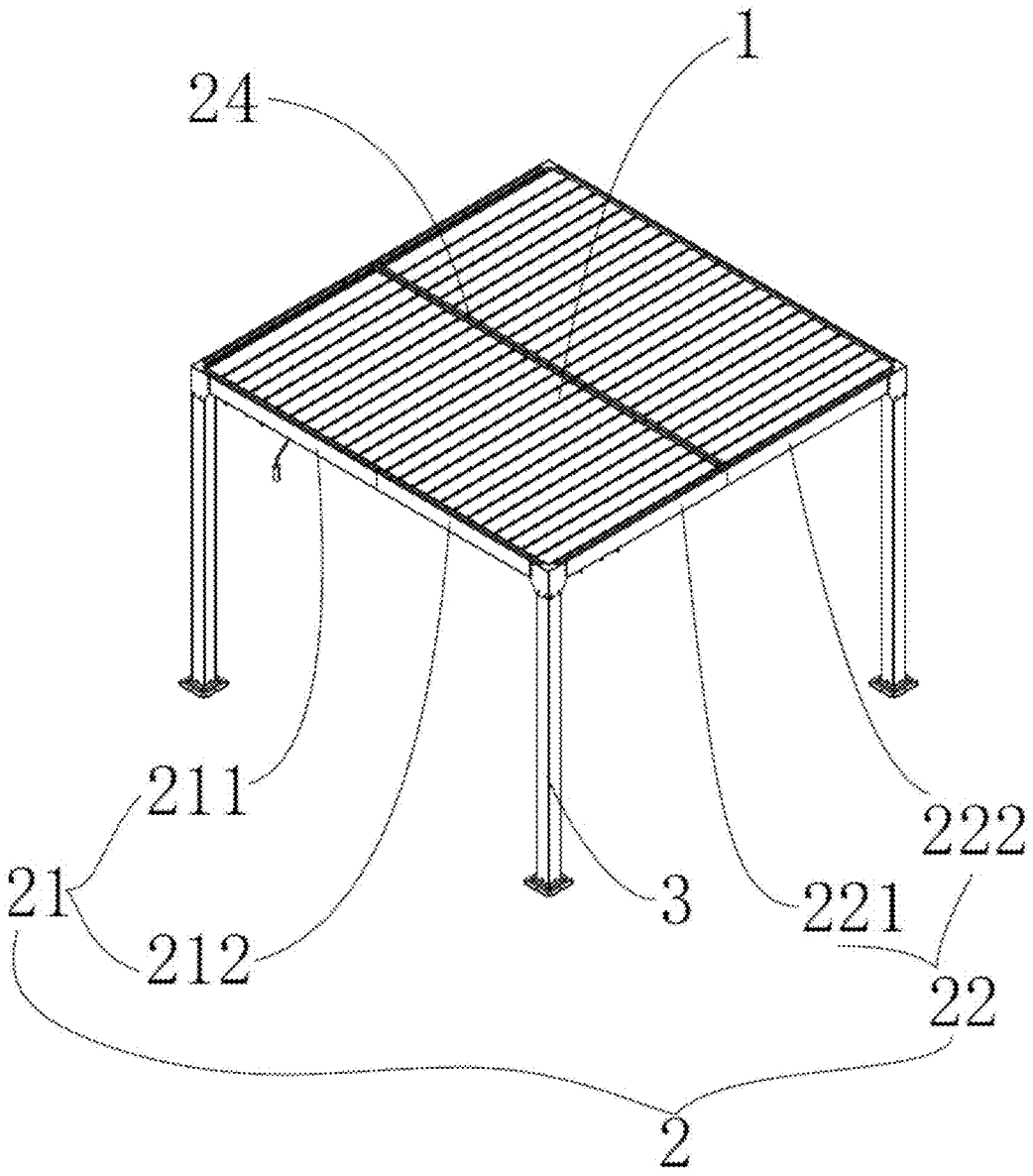
FIG. 1 is a schematic diagram of an overall structure of a sunshade canopy according to an embodiment of the present application.

In the description of the present application, it should be noted that the orientations or positional relationships indicated by the terms "upper", "lower", "inner", "outer", "front", "rear" etc. are based on the orientation or positional relationship shown in the drawings. The positional relationship is only for the convenience of describing the present application and simplifying the description, but does not indicate or imply that the referred device or element must have a specific orientation, be constructed and operated in a specific orientation, and thus should not be construed as limitation of the present application.

The present application will be described in further detail below in conjunction with the accompanying drawing.

Figure 2:
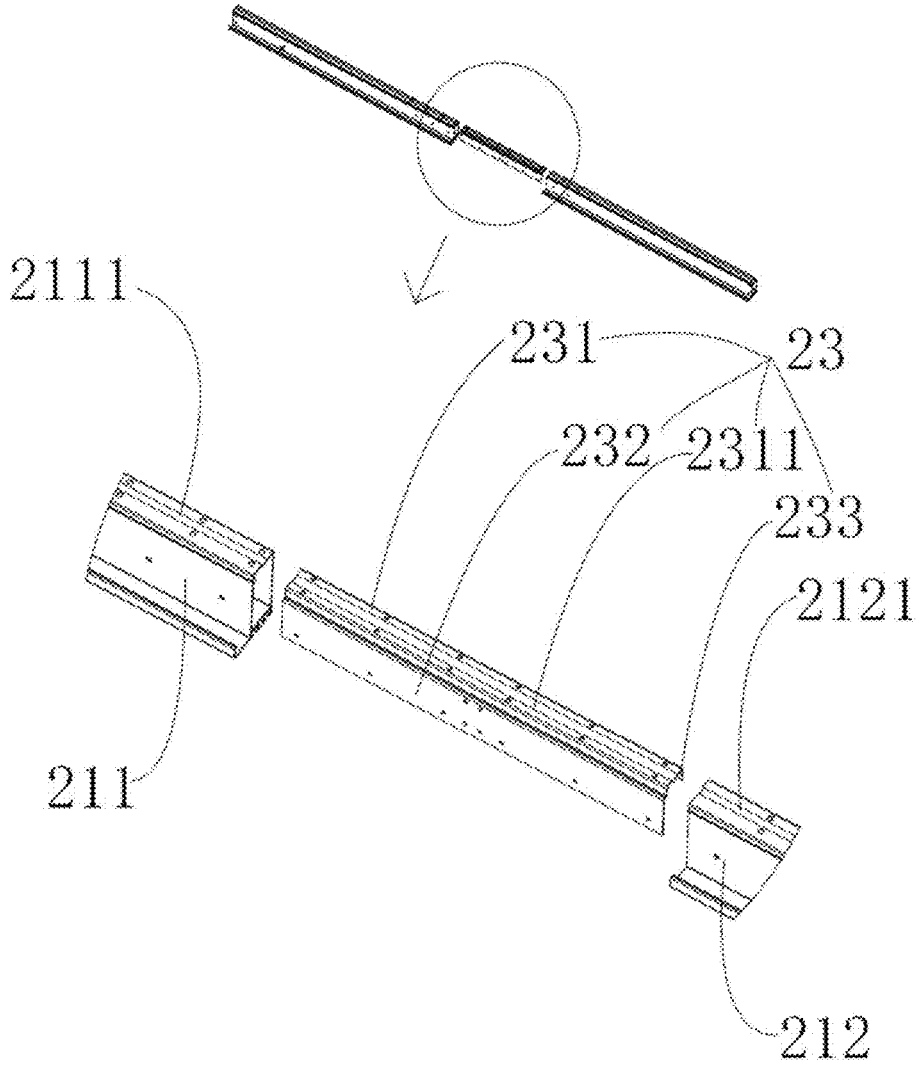
FIG. 2 is a schematic exploded structural diagram illustrating a longitudinal beam and a first fixing member.
Figure 3:
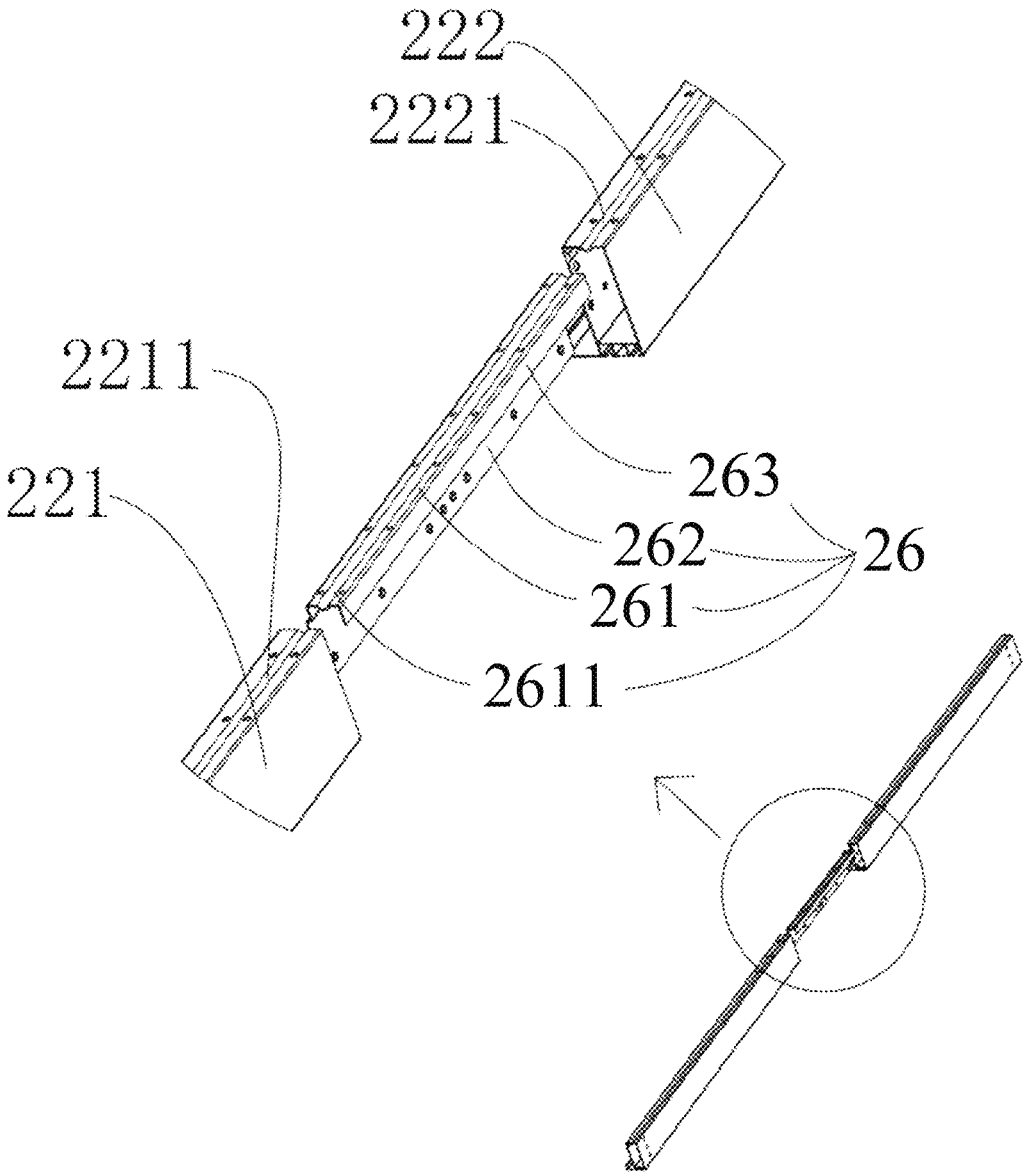
FIG. 3 is a schematic exploded structural diagram illustrating a horizontal beam and the fourth fixing member.
Figure 4:
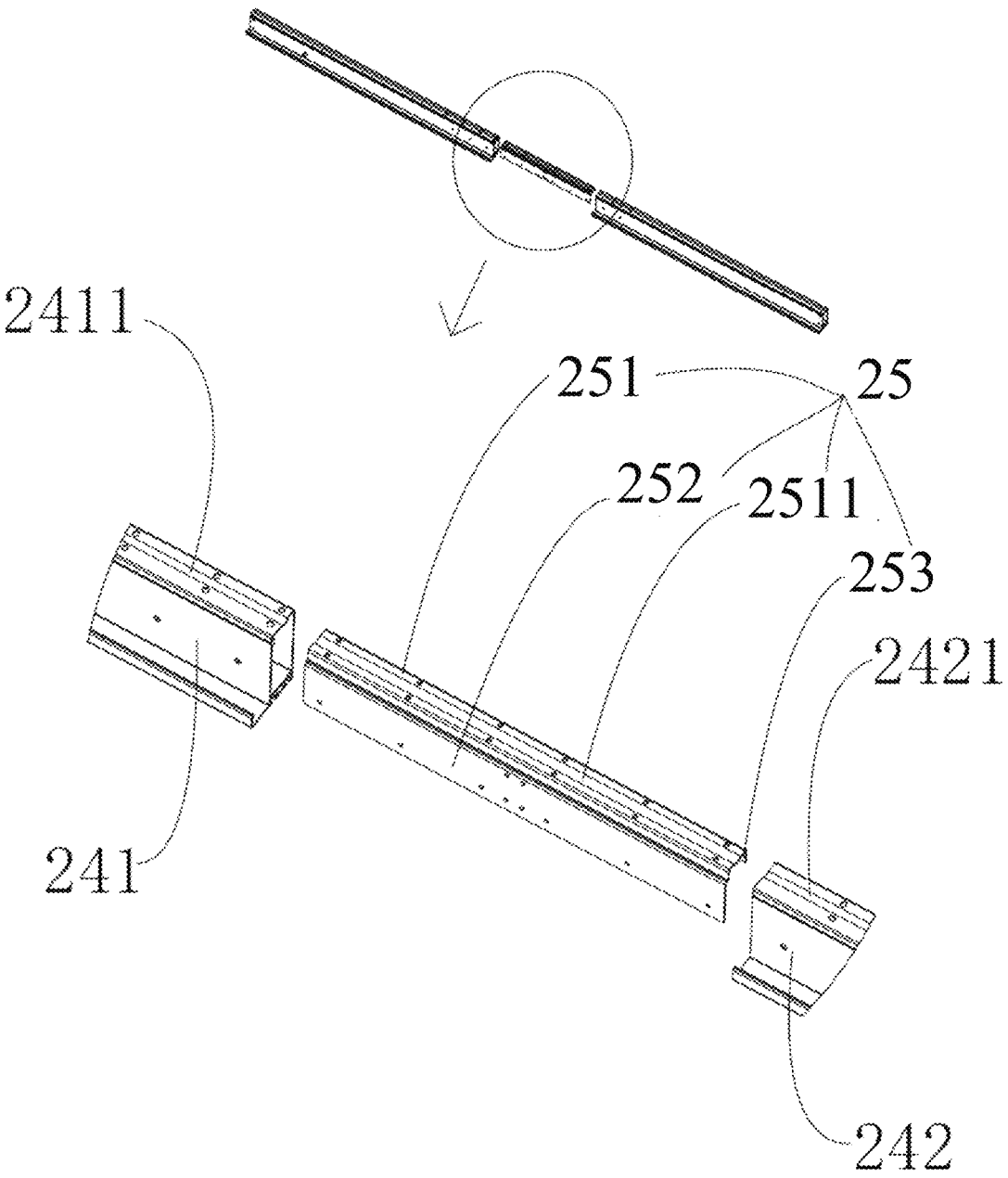
FIG. 4 is a schematic exploded structural diagram illustrating a middle beam and the third fixing member.
Figure 5:
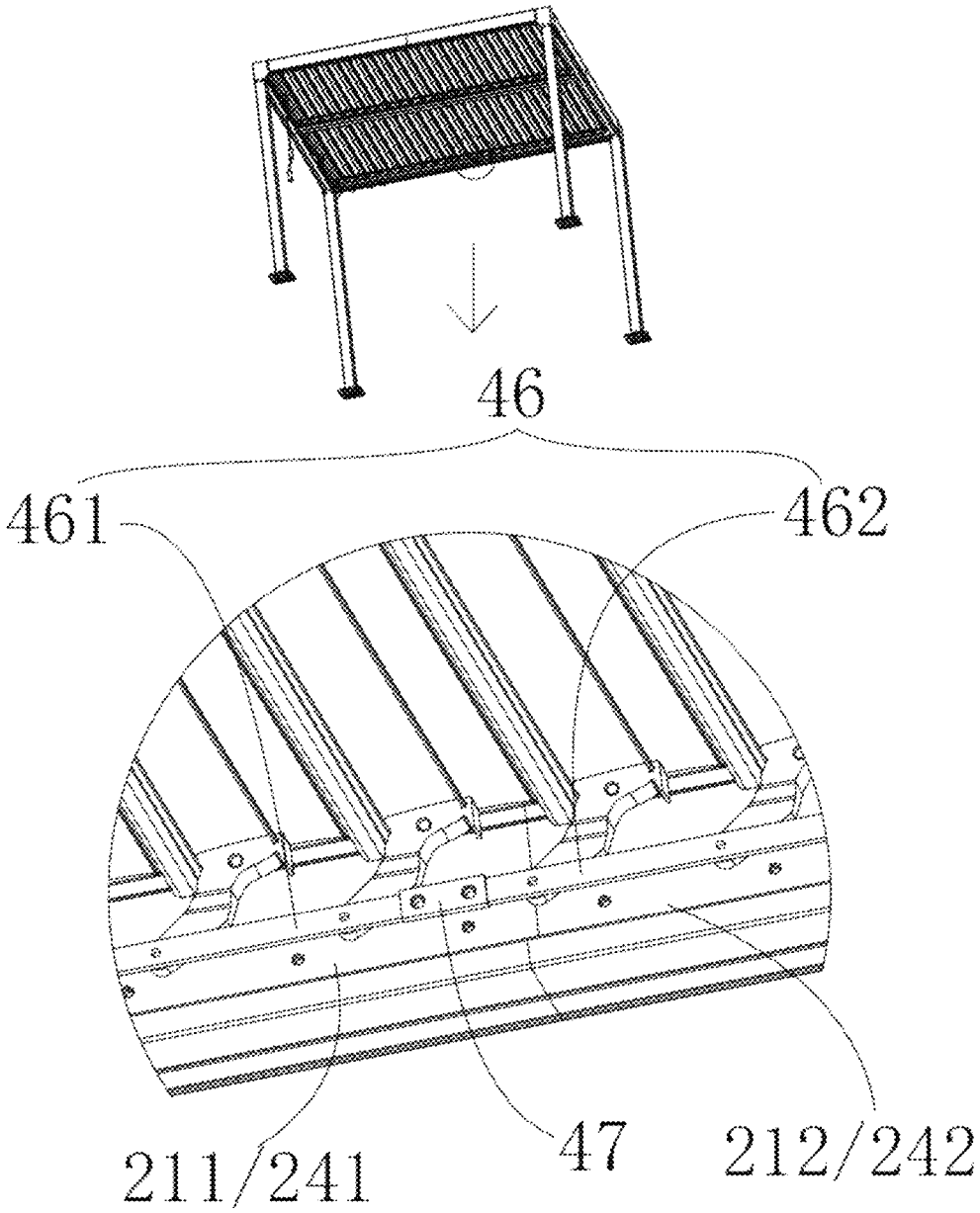
FIG. 5 is a schematic partially enlarged diagram of the overall structure illustrating a transmission strip and a second fixing member.
Figure 6:
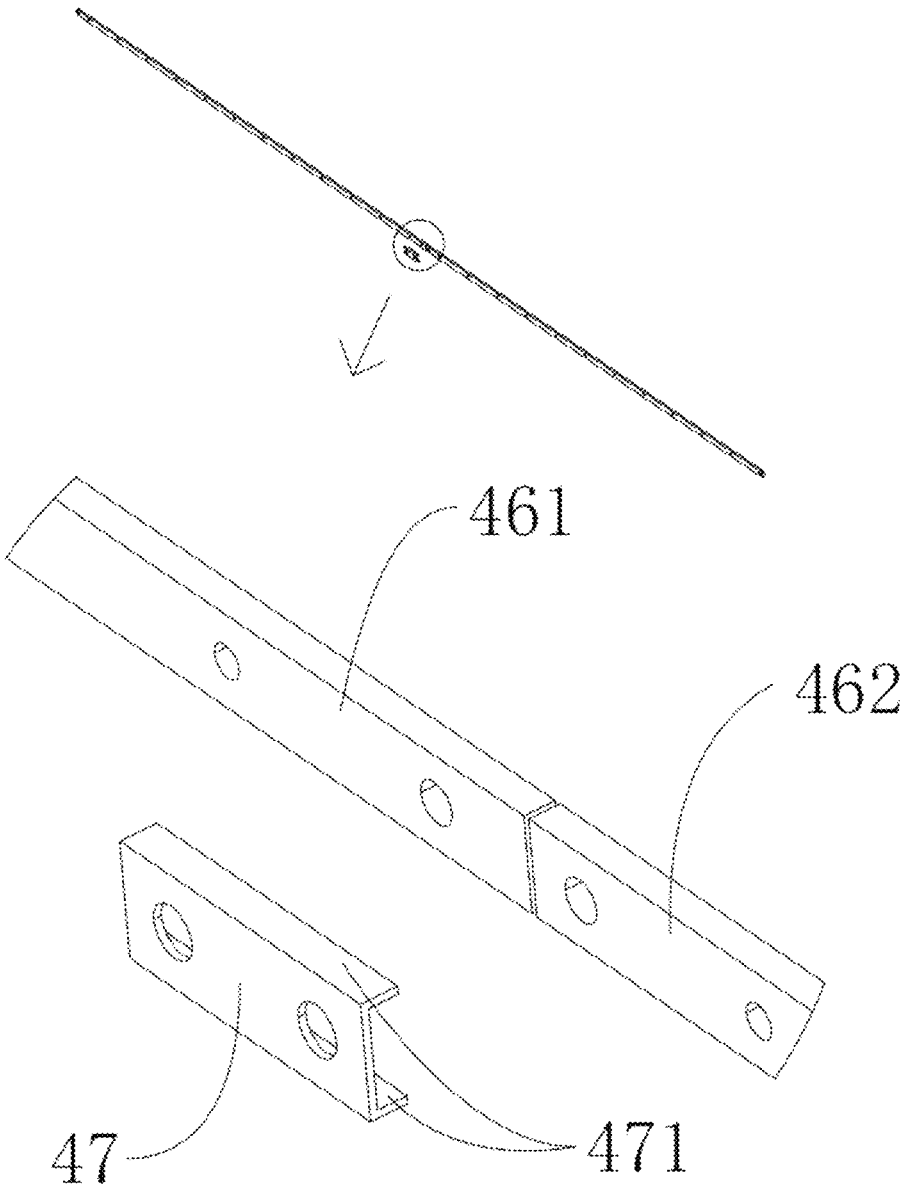
FIG. 6 is a schematic exploded structural diagram illustrating the transmission strip and the second fixing member.
Figure 7:
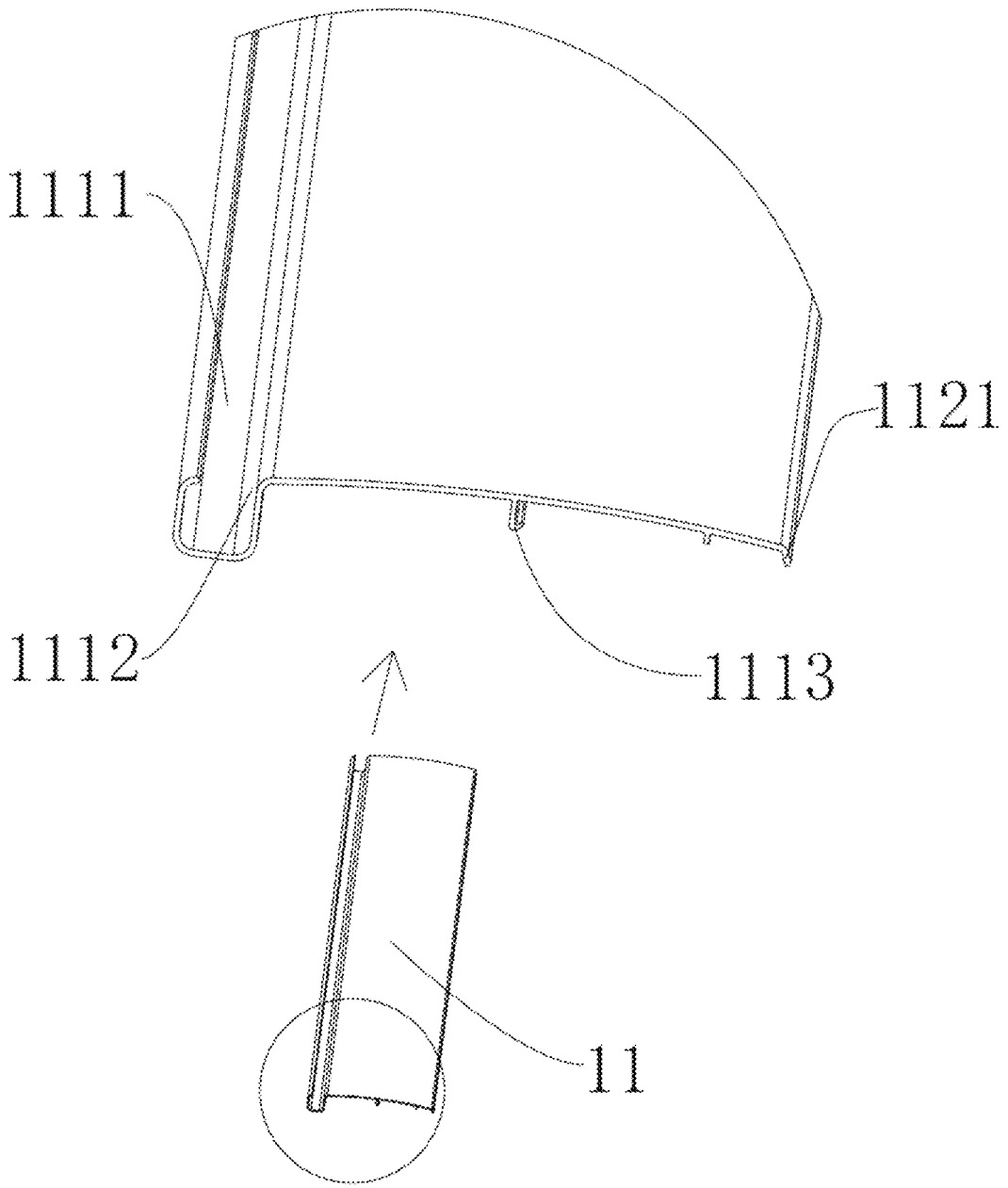
FIG. 7 is a first schematic partially enlarged diagram illustrating a sunshade panel.
Figure 8:
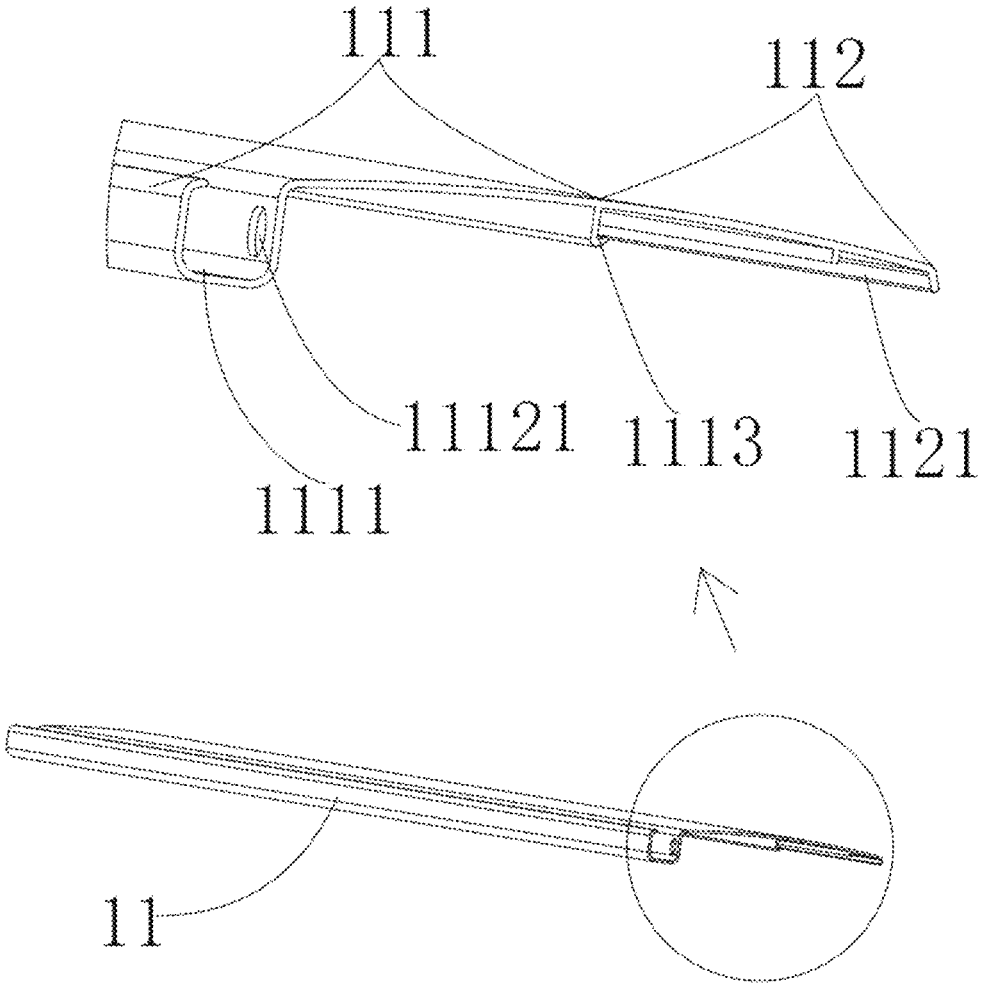
FIG. 8 is a second schematic partially enlarged diagram illustrating the sunshade panel.
Figure 9:
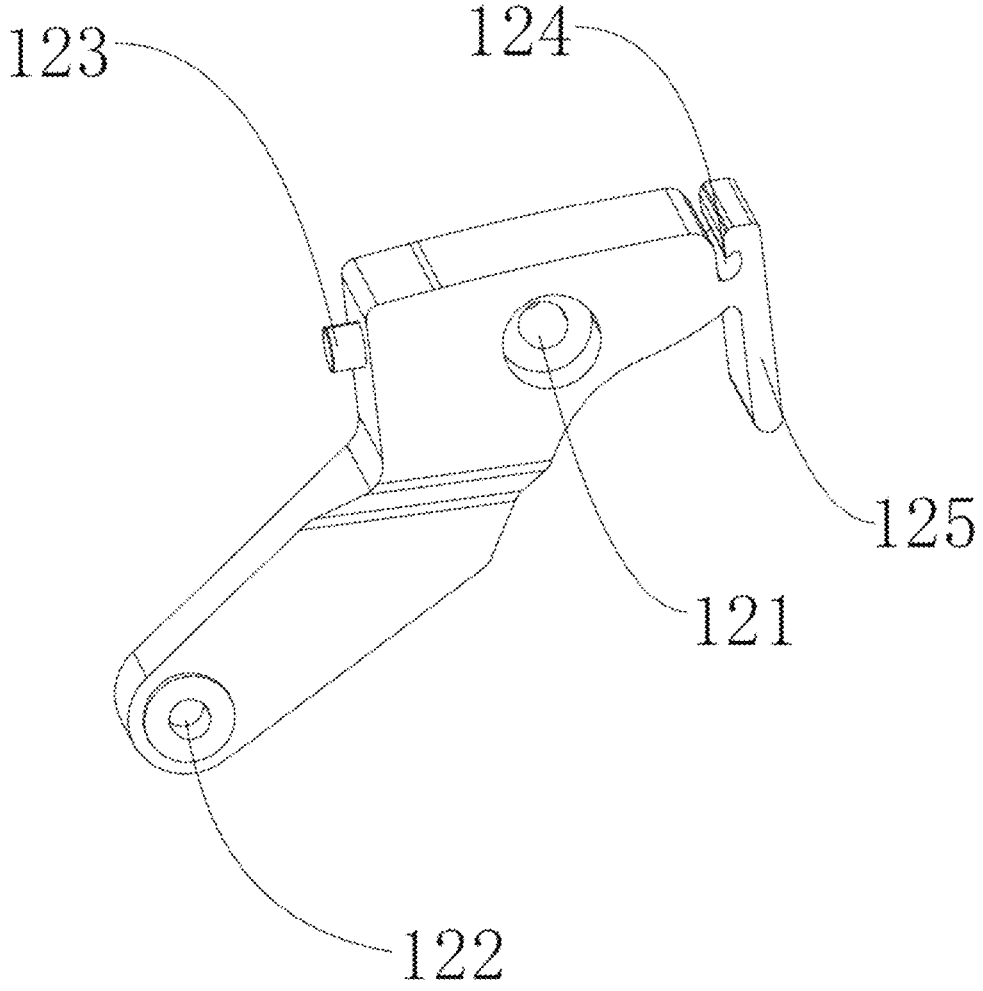
FIG. 9 is a schematic structural diagram illustrating a connecting member.
Figure 10:
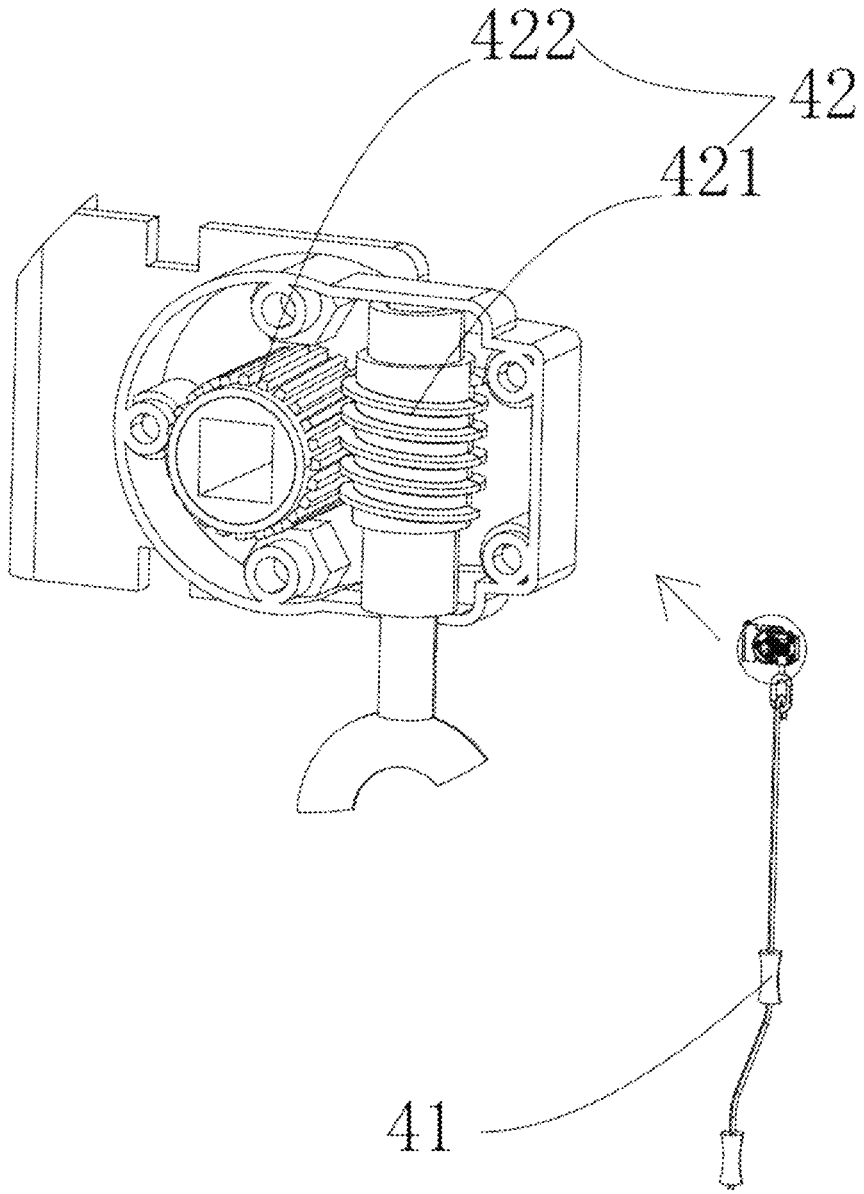
FIG. 10 is a schematic structural diagram illustrating a steering gear.
Figure 11:
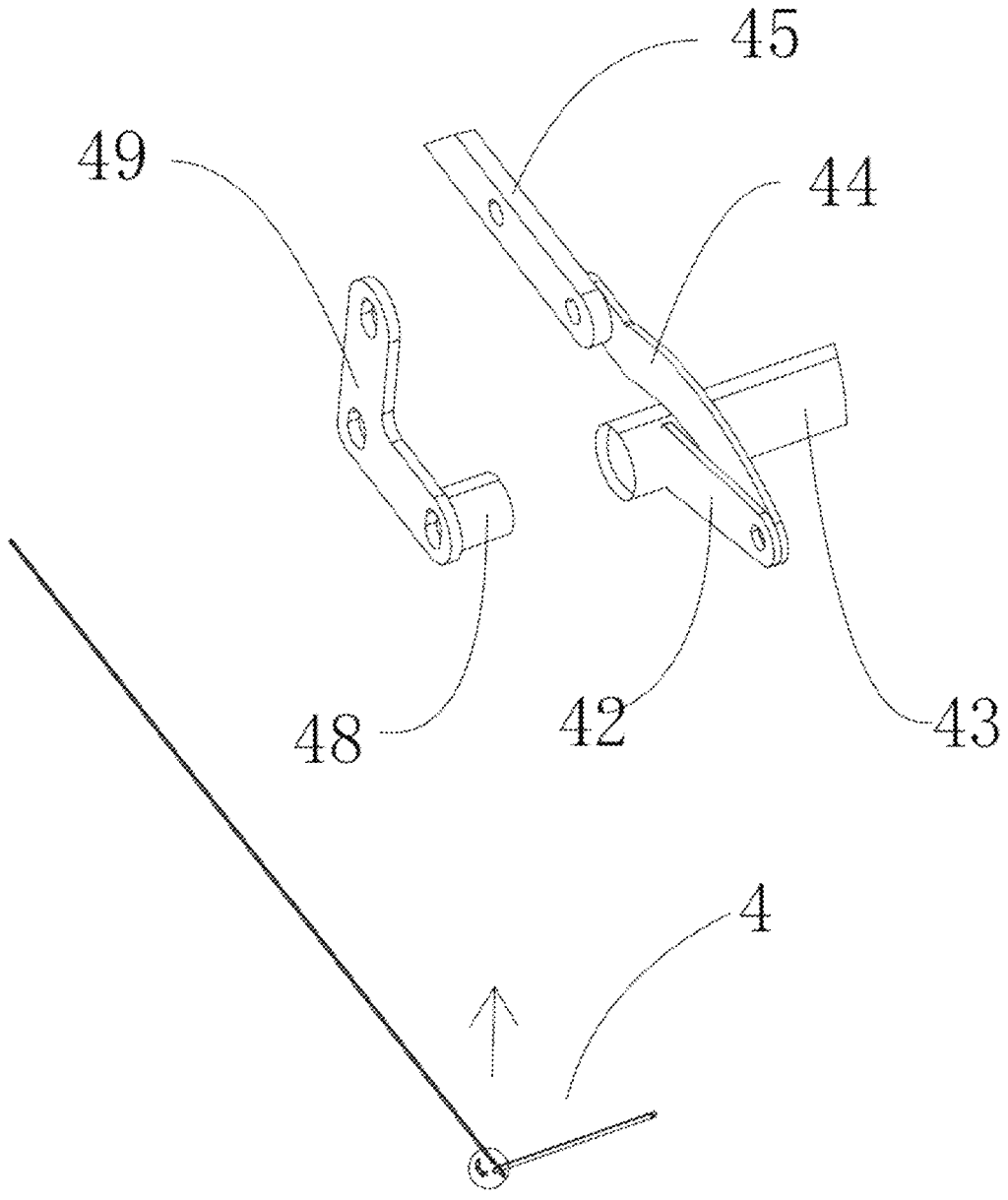
FIG. 11 is a schematic exploded structural diagram illustrating a transmission device.
Figure 12:
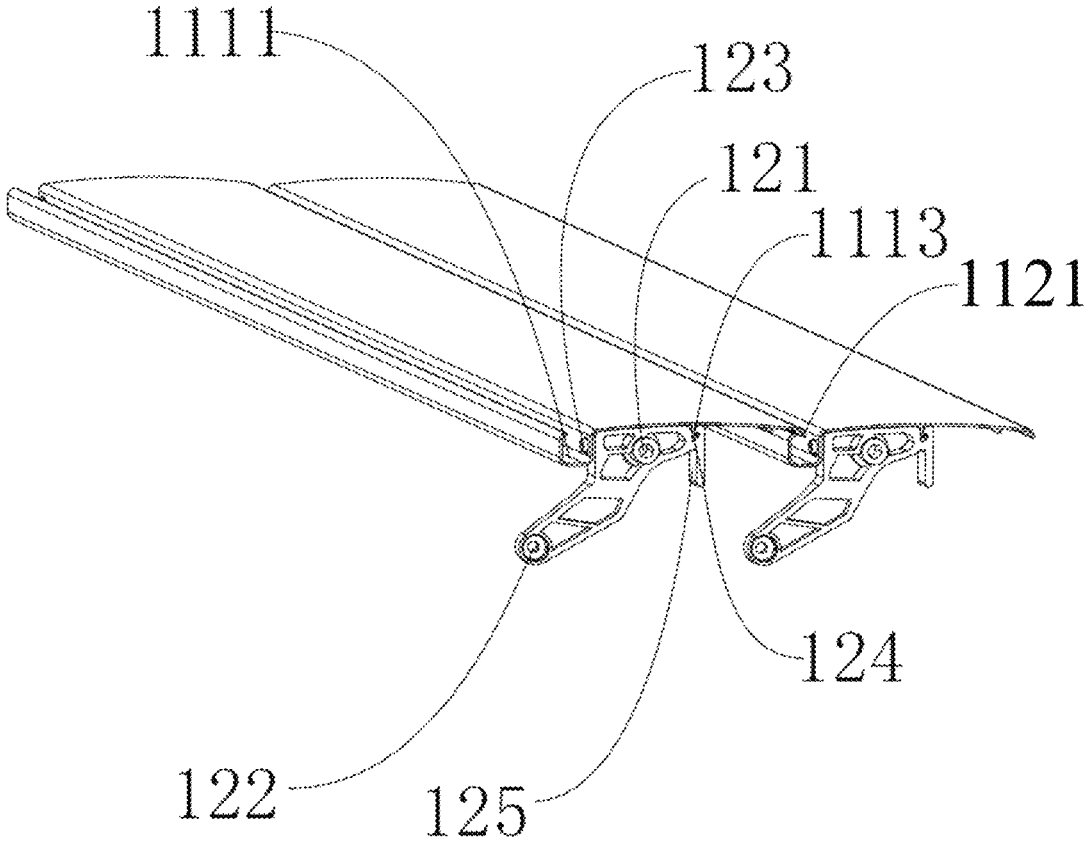
FIG. 12 is a schematic combined structural diagram illustrating the sunshade panel and the connecting member according to an embodiment of the present application.
Figure 13:
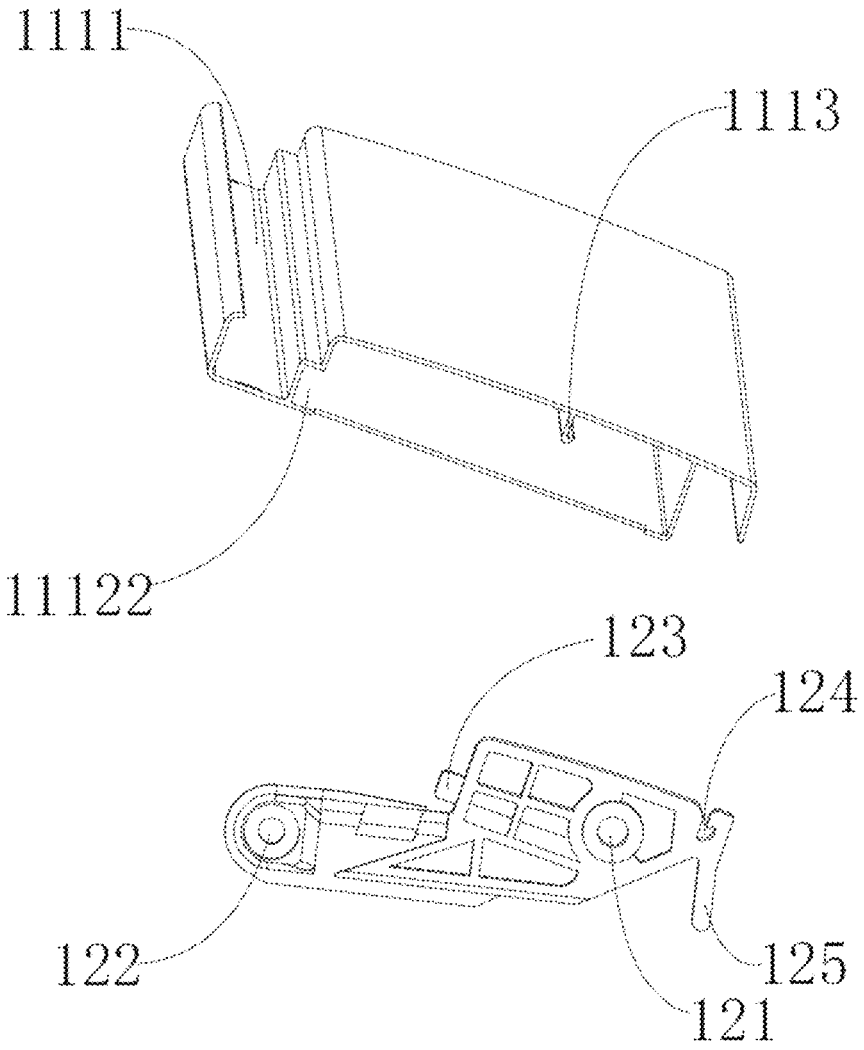
FIG. 13 is a schematic exploded structural diagram illustrating the sunshade panel and the connecting member according to another embodiment of the present application.
Figure 14:
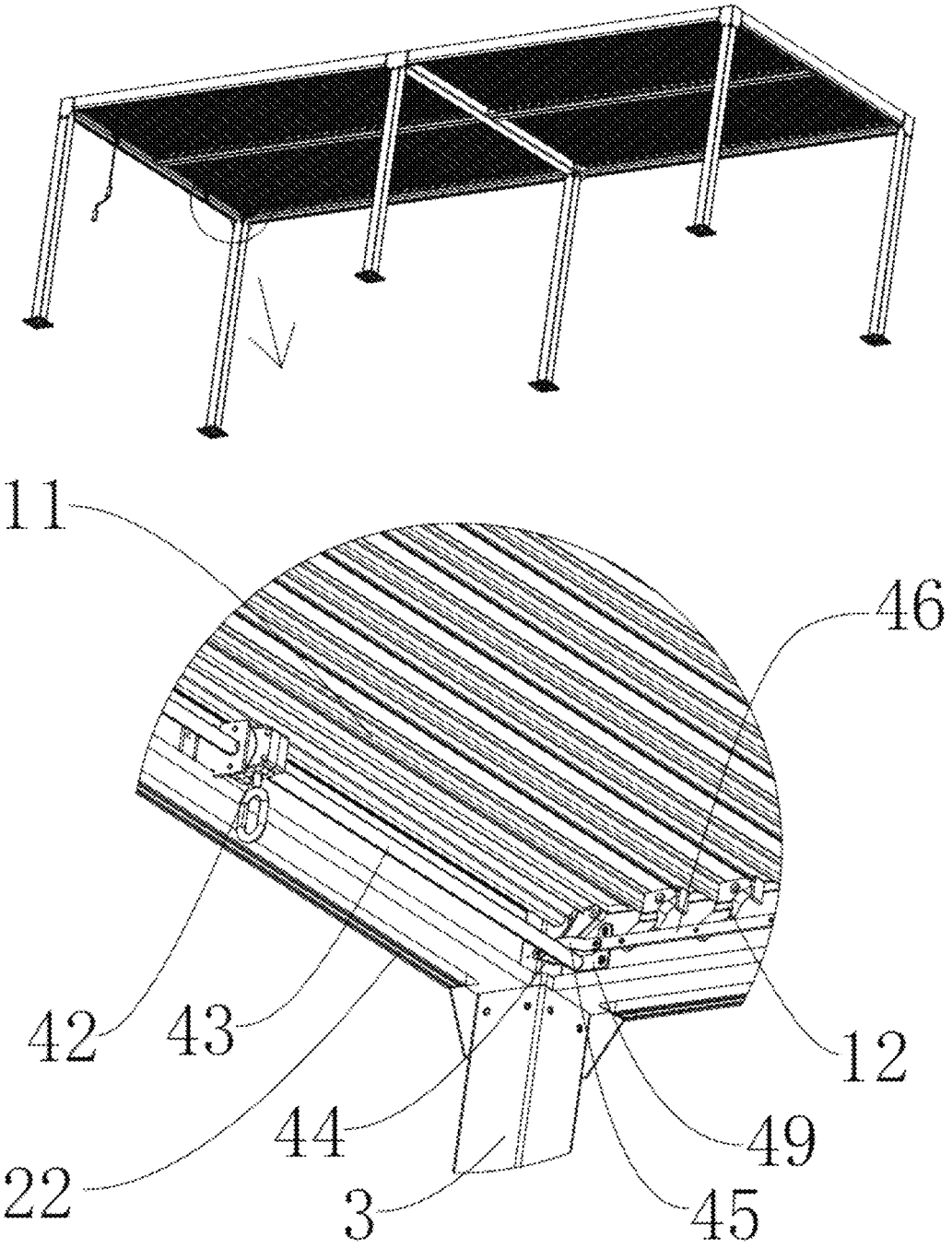
FIG. 14 is a schematic partially enlarged diagram of the overall structure.
Figure 15:
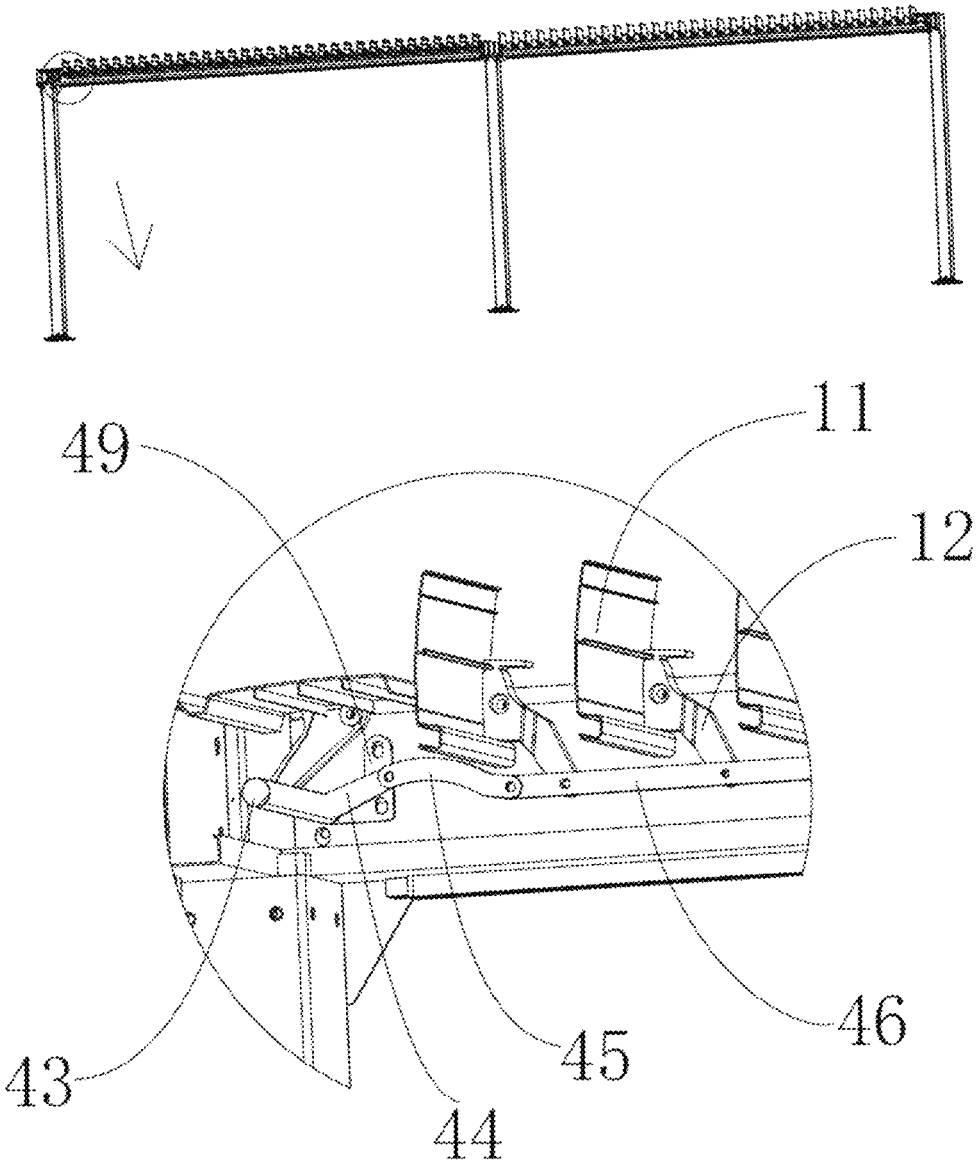
FIG. 15 is another schematic partially enlarged diagram of the overall structure.
Figure 16:
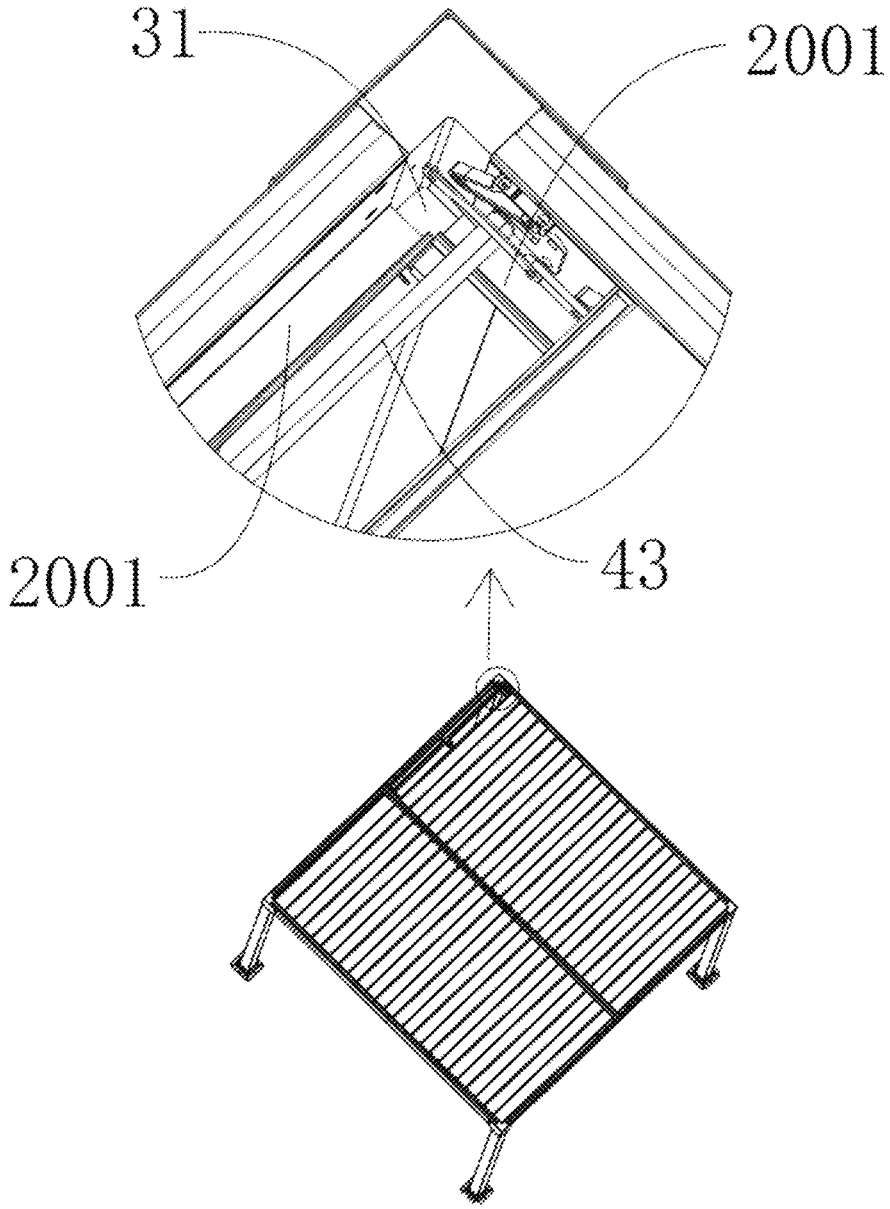
FIG. 16 is still another schematic partially enlarged diagram of the overall structure.

As shown in FIGS. 1-16, a sunshade canopy 1 comprises a canopy top 1, a frame 2, and supporting legs 3. The canopy top 1 is arranged on the frame 2, while the supporting legs 3 support the frame 2. The frame 2 includes hollow longitudinal beams 21, hollow horizontal beams 22, and first fixing members 23. Each of the first fixing members 23 has an upper connecting surface 231 and a first side connecting surface 232 that are perpendicular to each other. The upper connecting surface 231 and the first side connecting surface 232 are provided with screw holes. Each of the longitudinal beams 21 has two sections: a first longitudinal beam section 211 and a second longitudinal beam section 212. The upper and side walls of the abutting ends of the first longitudinal beam section 211 and the second longitudinal beam section 212 are respectively provided with screw holes that correspond to the screw holes of the upper connecting surface 231 and the first side connecting surface 232. The first fixing members 23 connect the first and second longitudinal beam sections 211 and 212 with fastening bolts. The canopy top 1 is covered with evenly arranged sunshade panels 11 that are connected with the longitudinal beams 21 through connecting parts 12. Two longitudinal beams 21 and two horizontal beams 22 form the smallest unit that surrounds the frame 2. Several units can be connected to each other to create a larger frame.

In the frame 2 of the smallest unit, a middle beam 24 can be arranged in parallel between the two longitudinal beams 21. The middle beam 24 has two sections: a first middle beam section 241 and a second middle beam section 242. The upper and side walls of the abutting ends of the first middle beam section 241 and the second middle beam section 242 are respectively provided with screw holes that correspond to the screw holes of the upper connecting surface 251 and the third side connecting surface 252. One third fixing member 25 connects the first and second middle beam sections 241 and 242 with fastening bolts. The sunshade panels 11 are connected to the middle beam 24 via connecting members 12. The middle beam 24 can enhance the rigidity of the frame 2 and provide a more flexible space for matching the size and type of the components forming the canopy top 1. The canopy top can either completely cover the entire frame 2 or be divided into two parts and combined to cover the entire frame 2 with the middle beam 24 as a boundary.

In one embodiment, each of the first longitudinal beam sections 211 and each of the second longitudinal beam sections 212 are vertically provided with first longitudinal beam grooves 2111 and second longitudinal beam grooves 2121, respectively, on the same straight line. Each of the upper connecting surfaces 231 is provided with a first groove 2311, which can fit one of the first longitudinal beam grooves 2111 and one of the second longitudinal beam grooves 2121 to limit relative movement. The first middle beam section 241 and the second middle beam section 242 are vertically provided with a first middle beam groove 2411 and a second middle beam groove 2421, respectively, on the same straight line. The third groove 2511 can fit the first middle beam groove 2411 and the second middle beam groove 2421 to limit relative movement. Each of the first fixing members 23 is also provided with a second side connecting surface 233. Each of the third fixing members 25 is also provided with a fourth side connecting surface 253. Each of the fourth fixing members 26 is also provided with a sixth side connecting surface 263. The side walls opposite to the side walls connecting the longitudinal beams 21 and/or the middle beam 24 to the first side connecting surfaces 232 fit the second connecting surfaces 233.

Each of the horizontal beams 22 has two sections: a first horizontal beam section 221 and a second horizontal beam section 222. The upper walls and side walls of the abutting ends of the first horizontal beam section 221 and the second horizontal beam section 222 are respectively provided with screw holes corresponding to the screw holes of the upper connecting surface 261 and the fifth side connecting surface 262. Each of the first horizontal beam sections 221 and each of the second horizontal beam sections 222 are horizontally provided with first horizontal beam grooves 2211 and second horizontal beam grooves 2221, respectively, on the same straight line. The fourth groove 2611 can fit one of the first horizontal beam grooves 2211 and one of the second horizontal beam grooves 2221 to limit relative movement. One fourth fixing member 26 connects one of the first horizontal beam sections 221 and one of the second horizontal beam sections 222 by fastening bolts.

It can be seen that the longitudinal beams 21, the horizontal beams 22, and the middle beam 24 can be assembled and disassembled using the first fixing members 23, the fourth fixing members 26, the third fixing members 25, and the lengths of the respective sections of the longitudinal beams 21, the horizontal beams 22, and the middle beam 24 before installation or after being disassembled are half of the overall lengths, respectively, which greatly reduces the size for production and transportation.

In one embodiment, each of the sunshade panels 11 has two parts: a shielding part 112 and a connecting part 111. A rear end of the connecting part 111 is provided with a first drainage groove 1111 with an upper opening horizontally, and a front side wall of the first drainage groove 1111 is provided with a fixing seat 1112. An upper tail of the connecting member 12 is provided with a protruding connecting column 123, which is detachably connected with the fixing seat 1112. A middle part of the connecting member 12 is provided with a first connecting hole 121. The screw holes on the inner side of the longitudinal beam 21 and/or the middle beam 24 and the first connecting holes 121 are connected via bolts so that the connecting members 12 and the longitudinal beam 21 and/or the middle beam 24 can be connected flexibly. A front end of the shielding part 112 is set as a downwardly inclined shielding edge 1121. The shielding edge 1121 of a rear sunshade panel 11 shields a rear wall of the first drainage groove 1111 of an adjacent front sunshade panel 11. When it rains, the rainwater on a certain sunshade panel 11 can flow backward into the first drainage groove 1111 of a behind sunshade panel 11, or it can flow forward along the shielding edge 1121 into the first drainage groove 1111 of an adjacent sunshade panel 11, which improves the drainage effect and prevents rain leakage.

In one embodiment, each fixing seat 1112 is designed as a through hole 11121 located on the front side wall of the first drainage groove 1111, allowing the connecting column 123 to pass through for a fixed connection. Preferably, the through hole 11121 is circular, and the connecting column 123 is shaped correspondingly to a cylinder for easy insertion and removal from the through hole 11121.

Alternatively, in another embodiment, each fixing seat 1112 is formed as a limiting slot 11122 by bending the front side wall of the first drainage groove 1111. The connecting column 123 is inserted into the limiting slot 11122 to establish a fixed connection. Preferably, the limiting slot 11122 is square, and the connecting column 123 is also shaped as a corresponding square column, which is advantageous for manufacturing since sunshade panels 11 are generally made of metal materials.

In one embodiment, the connecting member 12 is an integrally formed plastic component. A hook-shaped strip 1113 extends downward from the front end of the connecting part 111 to form a barb at the top. The front end of the connecting member 12 has a hook-shaped groove 124 that opens upward and has the same shape as the hook-shaped strip 1113 to provide a secure fit. The front side wall of the hook-shaped groove 124 extends downward to form a pressing sheet 125, which can be pressed from the front to cause deformation and enlarge the opening of the hook-shaped groove 124. In the default state, the hook-shaped groove 124 and the hook-shaped strip 1113 are embedded with each other to establish the connection between the sunshade panels 11 and the connecting members 12. When replacement or removal is required, pressing the pressing sheet 125 can enlarge the opening of the hook-shaped groove 124, allowing the hook-shaped groove 124 and the hook-shaped strip 1113 to disengage. At this point, moving the connecting member 12 forward disengages the connecting column 123 from the fixing seat 1112, separating the sunshade panels 11 and the connecting members 12.

In one embodiment, a transmission device 4 is included. The transmission device 4 includes a fixed seat 49, a fixed shaft 48, a rotating shaft 43, a rotating strip 44, an active strip 45, and a transmission strip 46. The fixed seat 49 is fixedly connected to the inner side wall of the longitudinal beams 21 and/or the middle beam 24. The fixed shaft 48 is integrally arranged with the fixed seat 49 and extends laterally to the middle part of the frame 2. The rotating shaft 43 is horizontally arranged at an end close to the horizontal beams 22 and is hollowly sleeved on the fixed shafts 48 of both sides, allowing axial rotation. An outer surface of an end of the rotating shaft 43 is vertically connected to an end of the rotating strip 44. The other end of the rotating strip 44 and an end of the transmission strip 46 are provided with screw holes, and both sides of the active strip 45 are also provided with screw holes, allowing the other end of the rotating strip 44 and the end of the transmission strip 46 to be movably connected with both sides of the active strip 45 via bolts in the screw holes.

The transmission strip 46 is longitudinally provided with several equidistant screw holes. The tails of the connecting members 12 are provided with second connecting holes 122. Several connecting members 12 are movably connected to the transmission strip 46 via the second connecting holes 122 and the screw holes on the transmission strip 46. The connecting members 12 are movably connected with the longitudinal beams 21 and/or the middle beam 24 via the bolts passing through the first connecting holes 121 and the screw holes on the longitudinal beams 21 and/or the middle beam 24. The rotating shaft 43 rotates to realize the opening and closing of the sunshade panels 11.

In one embodiment, the transmission strip 46 has two sections: a first transmission strip section 461 and a second transmission strip section 462. Abutting ends of the first transmission strip section 461 and the second transmission strip section 462 are respectively provided with screw holes. A second fixing member 47 is also included, which is provided with screw holes at both ends and is fixedly connected to the first transmission strip section 461 and the second transmission strip section 462 by bolts. An upper side and a lower side of the second fixing member 47 are respectively extended to form baffles 471. Opposite sides of the baffles 471 fit the upper and lower sides of the transmission strip 46, respectively, to prevent relative movement. Since the transmission strip 46 is split into two parts, its length can be reduced to half of the original length, further reducing the overall package size of the sunshade canopy.

In one embodiment, a steering gear 42 is also included. The steering gear 42 is fixedly arranged on the inner side of one second horizontal beam section 222. The steering gear 42 is connected to the rotating shaft 43 and drives it to rotate after force transformation. Preferably, the steering gear 42 includes a worm gear 422 and a worm 421 which are driven by the rotation of a hand rocker 41.

In one embodiment, the middle part of the worm gear 422 is set as a polygonal hole, and the connection part of the rotating shaft 43, which is connected to the worm gear 422, is set as a polygonal structure of the same shape. The polygonal edges can prevent the rotation of the rotating shaft and the worm gear after being plugged from slipping. The polygon is preferably a regular quadrilateral, which is convenient for production and processing.

In one embodiment, the steering gear 42 is arranged between one longitudinal beam 21 and the middle beam 24 and achieves transmission by connecting two rotating shafts 43 of equal length located on the left and right sides respectively. On the one hand, the lengths of the rotating shafts 43 are reduced to half of the whole length; on the other hand, since the canopy top 1 has a certain weight and many parts participate in the movement process, setting the steering gear 42 in the middle position to drive both sides to move synchronously can transmit power more evenly compared with setting it on one side and relying on one side to drive the other side to move, which improves efficiency and reduces the probability of component damage.

In one embodiment, a second drainage groove 2001 is provided under the inner side surfaces of the frame 2 and has the same orientation as that of the frame 2. The supporting legs 3 are set as a hollow structure, and drainage holes 31 are opened at the upper ends of the supporting legs 3. The drainage holes 31 communicate with the second drainage groove 2001. Through holes are provided on the side walls of the lower ends of the supporting legs 3. When drainage is required, the rainwater from the canopy top 1 flows into the second drainage groove 2001, then flows into the drain holes 31 through the second drainage groove 2001, and then enters the hollow supporting legs 3 and finally discharges via the through holes of the supporting legs 3.

In the production and transportation process prior to installation, the frame 2 can be connected in a way that meets specific requirements. For instance, any or all of the longitudinal beams 21, the horizontal beams 22, and the middle beam 24 can be produced and transported in two sections. During installation, these components are fixedly connected using the first fixing members 23, the fourth fixing members 26, and the third fixing members 25. Similarly, if necessary, the transmission strips 46 can also be produced and transported in two sections and then fixedly connected using the second fixing members 47 during installation. Furthermore, each part of the transmission device 4 is installed at the appropriate position. The combined sunshade panels 11 and the connecting members 12 form the canopy top 1 and cover the frame 2. The connecting members 12 are flexibly connected to the screw hole of the longitudinal beams 21 or the second middle beam section 242 through the first connecting holes 121 at the middle part. Once connected, the connecting members 12 rotate with the bolt in the first connecting holes 121 serving as the axis. The connecting members 12 are flexibly connected to the screw holes of the transmission strips 46 through the second connecting holes 122 at the lower tails. The forward and backward movement of the transmission strip 46 drives the connecting members 12 to rotate, which then drives the opening and closing movement of the sunshade panels 11.

In its default state, the rotating strip 44 faces one side of the horizontal beams 22. In this position, the sunshade panels 11 are closed, providing sunshade or rain protection. When the hand rocker 41 is shaken, the horizontal rotation of the worm 421 is transformed into vertical rotation through the worm gear 422, which drives the rotating shaft 43. Once the rotating shaft 43 rotates, the rotating strip 44 rotates away from the horizontal beams 22. At this point, the movable strip 45 pushes the driving strip 46 forward, causing the connecting members 12 to move counterclockwise and opening the sunshade panels 11. When shaking of the hand rocker 41 stops, the sunshade panels 11 stop moving and are in the corresponding open state. To close them, the hand rocker 41 can be shaken in reverse until the sunshade panels 11 are completely closed.

Based on the above description, it is evident that the aforementioned embodiments achieve the following technical effects. The lengths of the longitudinal beams in the frame are typically longer, making their production and transportation the most challenging and largely determining the overall packaging size of the sunshade canopy. By dividing one or all longitudinal beams into two sections and connecting/disconnecting them using the first fixing members, it is possible to effectively reduce the production difficulty and transportation cost.

The above are only exemplary implementations of the present application, and are not intended to limit the protection scope of the present application, which is determined by the appended claims.

What is claimed is:

1. A sunshade canopy, comprising:

a frame comprising hollow longitudinal beams and hollow horizontal beams;

a canopy top arranged on the frame; and supporting legs supporting the frame, wherein one of the longitudinal beams comprises a first longitudinal beam section and a second longitudinal beam section which are connected via a first fixing member;

the first fixing member has an upper connecting surface and a first side connecting surface which are perpendicular to each other and have screw holes;

upper walls and side walls of abutting ends of the first longitudinal beam section and the second longitudinal beam section are provided with screw holes corresponding to the screw holes on the upper connecting surface and the first side connecting surface of the first fixing member respectively; the first fixing member fastens the first longitudinal beam section and the second longitudinal beam section via bolts;

the canopy top is covered with uniformly arranged sunshade panels which are connected to the longitudinal beams via connecting members;

the sunshade canopy further comprises a middle beam arranged in parallel between two adjacent longitudinal beams, the middle beam comprises a first middle beam section and a second middle beam section, upper walls and side walls of abutting ends of the first middle beam section and the second middle beam section are provided with screw holes corresponding to the screw holes on the upper connecting surface and the first side connecting surface of a third fixing member respectively, the third fixing member fastens the first middle beam section and the second middle beam section via bolts; the sunshade panels are connected to the middle beam via the connecting members; and the first longitudinal beam section and the second longitudinal beam section are vertically provided with a first longitudinal beam groove and a second longitudinal beam groove respectively on a same straight line, the upper connecting surface of the first fixing member is provided with a first groove, and the first groove fits the first longitudinal beam groove and the second longitudinal beam groove to limit relative movement.

2. The sunshade canopy according to claim 1, wherein the first middle beam section and the second middle beam section are vertically provided with a first middle beam groove and a second middle beam groove respectively on a same straight line, and the third groove fits the first middle beam groove and the second middle beam groove to limit relative movement.

3. The sunshade canopy according to claim 2, wherein the first and/or third fixing member further comprises a second side connecting surface, side walls opposite to side walls connecting the longitudinal beams and/or the middle beam to the first side connecting surfaces fit the second side connecting surfaces.

4. The sunshade canopy according to claim 1, wherein each of the sunshade panels comprises a shielding part and a connecting part, a rear end of the connecting part is provided with a first drainage groove with an upper opening horizontally, and a front side wall of the first drainage groove is provided with a fixing seat, an upper tail of the connecting member is provided with a protruding connecting column which is detachably connected with the fixing seat, a middle part of the connecting member is provided with a first connecting hole, screw holes on inner sides of the longitudinal beams and/or the middle beam and the first connecting holes are connected via bolts so that the connecting members and the longitudinal beams and/or the middle beam are connected flexibly.

5. The sunshade canopy according to claim 4, wherein the fixing seat is set as a through hole opened on a front side wall of the first drainage groove, and the connecting column passes through the through hole to form a fixed connection.

6. The sunshade canopy according to claim 4, wherein the fixing seat is set as a limiting slot formed by bending a front side wall of the first drainage groove, and the connecting column is inserted into the limiting slot to form a fixed connection.

7. The sunshade canopy according to claim 4, wherein the connecting member is an integrally formed member made of a plastic material, a front end of the connecting part is provided with a hook-shaped strip which extends downward to form a barb at a top end of the connecting part, a front end of the connecting member is provided with a hook-shaped groove opened upwards, the book-shaped groove has a same shape as the hook-shaped strip and form fixed fitting with the hook-shaped strip, a front side wall of the hook-shaped groove extends downwards and forms a pressing sheet, pressing the pressing sheet from a front side of the pressing sheet enlarges an opening of the hook-shaped groove.

8. The sunshade canopy according to claim 7, wherein a front end of the shielding part is set as a downwardly inclined shielding edge, the shielding edge of a rear sunshade panel shields a rear wall of the first drainage groove of a front adjacent sunshade panel.

9. The sunshade canopy according to claim 4, further comprising a transmission device which comprises a fixed seat, a fixed shaft, a rotating shaft, a rotating strip, an active strip and a transmission strip, wherein the fixed seat is fixedly connected on an inner side wall of the longitudinal beams and/or the middle beam, the fixed shaft is integrally arranged with the fixed seat, the fixed shaft is a cylindrical shape extending laterally to a middle part of the frame, the rotating shaft is horizontally arranged at an end close to the horizontal beams, and the rotating shaft is hollowly sleeved on the fixed shafts of both sides and is capable of axially rotating;

an outer surface of an end of the rotating shaft is vertically connected to an end of the rotating strip, another end of the rotating strip and an end of the transmission strip are provided with screw holes, and both sides of the active strip are provided with screw holes, so that the another end of the rotating strip and the end of the transmission strip are movably connected with the both sides of the active strip via bolts; and the transmission strip is longitudinally provided with equidistant screw holes, tails of the connecting members are provided with second connecting holes, the connecting members are movably connected to the transmission strip via the second connecting holes and the screw holes on the transmission strip, the connecting members are movably connected with the longitudinal beams and/or the middle beam via bolts passing through the first connecting holes and the screw holes on the longitudinal beams and/or the middle beam, the rotating shaft rotates to realize opening and closing of the sunshade panels.

10. The sunshade canopy according to claim 9, further comprising a second fixing member, wherein the transmission strip comprises a first transmission strip section and a second transmission strip section, abutting ends of the first transmission strip section and the second transmission strip section are respectively provided with screw holes, the second fixing member is provided with screw holes at both ends, and is fixedly connected to the first transmission strip section and the second transmission strip section by bolts.

11. The sunshade canopy according to claim 10, wherein an upper side and a lower side of the second fixing member are respectively extended to form baffles, opposite sides of the baffles fit the upper side and the lower side of the transmission strip respectively to prevent relative movement.

12. The sunshade canopy according to claim 9, further comprising a steering gear which is fixedly arranged on an inner side of one of the second horizontal beam sections, wherein the steering gear is connected with the rotating shaft, and drives the rotating shaft to rotate after realizing force transformation.

13. The sunshade canopy according to claim 12, wherein the steering gear comprises a worm gear and a worm which are driven by rotation of a hand rocker.

14. The sunshade canopy according to claim 13, wherein a middle part of the worm gear is set as a polygonal hole, and a connection part of the rotating shaft which is connected to the worm gear is set as a polygonal structure of the same shape.

15. The sunshade canopy according to claim 14, wherein the steering gear is arranged between the middle beam and one of the longitudinal beams, and realizes transmission by connecting two rotation shafts of equal length located at a left side and a right side respectively.

16. The sunshade canopy according to claim 4, wherein a second drainage groove is provided under inner side surfaces of the frame and has a same orientation as an orientation of the frame.

17. The sunshade canopy according to claim 16, wherein the supporting legs are hollow, and drainage holes are opened at upper ends of the supporting legs, the drainage holes communicate with the second drainage groove, through holes are provided on side walls of lower ends of the supporting legs.

18. The sunshade canopy according to claim 1, wherein one of the horizontal beams comprises a first horizontal beam section and a second horizontal beam section which are connected via the fourth fixing member; upper walls and side walls of abutting ends of the first horizontal beam section and the second horizontal beam section are provided with screw holes corresponding to the screw holes on the upper connecting surface and the first side connecting surface of the fourth fixing member respectively; the first horizontal beam section and the second horizontal beam section are vertically provided with a first horizontal beam groove and a second horizontal beam groove respectively on a same straight line, the first groove fits the first longitudinal beam groove and the second longitudinal beam groove to limit relative movement, the fourth fixing member fastens the first horizontal beam section and the second horizontal beam section via bolts.

* * * * *